US008393874B2

(12) United States Patent
Zazovsky et al.

(10) Patent No.: US 8,393,874 B2
(45) Date of Patent: Mar. 12, 2013

(54) HYBRID PUMPING SYSTEM FOR A DOWNHOLE TOOL

(75) Inventors: Alexander Zazovsky, Houston, TX (US); Mark Milkovisch, Cypress, TX (US); Pierre Campanac, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 551 days.

(21) Appl. No.: 12/624,809

(22) Filed: Nov. 24, 2009

(65) Prior Publication Data

US 2011/0123368 A1 May 26, 2011

(51) Int. Cl.
*F04B 49/20* (2006.01)

(52) U.S. Cl. ..... 417/16; 417/374

(58) Field of Classification Search ..... 417/16, 417/374

See application file for complete search history.

(56) References Cited

U.S. PATENT DOCUMENTS 4,026,661 A * 5/1977 Roeder ..... 417/53
6,641,434 B2 11/2003 Boyle et al.
6,986,282 B2 1/2006 Ciglenec et al.
7,114,562 B2 10/2006 Follini et al.

* cited by examiner

*Primary Examiner* — Charles Freay
*Assistant Examiner* — Patrick Hamo
(74) *Attorney, Agent, or Firm* — Cathy Hewitt; John Vereb

(57) ABSTRACT

A pumping system and method to be used within a downhole tool is disclosed herein. The pumping system includes a displacement unit having a cavity formed therein, in which the cavity is configured to receive a fluid therein. A hydraulic driving device and a mechanical driving device are then both included within the system such that both the hydraulic driving device and the mechanical driving device are configured to drive a piston of the displacement unit to receive the fluid within the cavity.

22 Claims, 8 Drawing Sheets

HYBRID PUMPING SYSTEM FOR A DOWNHOLE TOOL

BACKGROUND OF THE DISCLOSURE

Wells are generally drilled into the ground or ocean bed to recover natural deposits of oil and gas, as well as other desirable materials that are trapped in geological formations in the Earth's crust. As wells are typically drilled using a drill bit attached to the lower end of a "drill string." Drilling fluid, or mud, is typically pumped down through the drill string to the drill bit. The drilling fluid lubricates and cools the bit, and may additionally carry drill cuttings from the borehole back to the surface.

In various oil and gas exploration operations, it may be beneficial to have information about the subsurface formations that are penetrated by a borehole. For example, certain formation evaluation schemes include measurement and analysis of the formation pressure and permeability. These measurements may be essential to predicting the production capacity and production lifetime of the subsurface formation.

Reservoir well production and testing may involve drilling into the subsurface formation and the monitoring of various subsurface formation parameters. When drilling and monitoring, downhole tools having electric, mechanic, and/or hydraulic powered devices may be used. To energize downhole tools using hydraulic power, various systems may be used to pump fluid, such as hydraulic fluid. Such pump systems may be controlled to vary output pressures and/or flow rates to meet the needs of particular applications. Further, in some implementations, pump systems may be used to draw and pump formation fluid from subsurface formations. A downhole string (e.g., a drill string, coiled tubing, slickline, wireline, etc.) may include one or more pump systems depending on the operations to be performed using the downhole string. However, traditional pump systems may be limited in operation by the range of flow rates that may be achieved.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
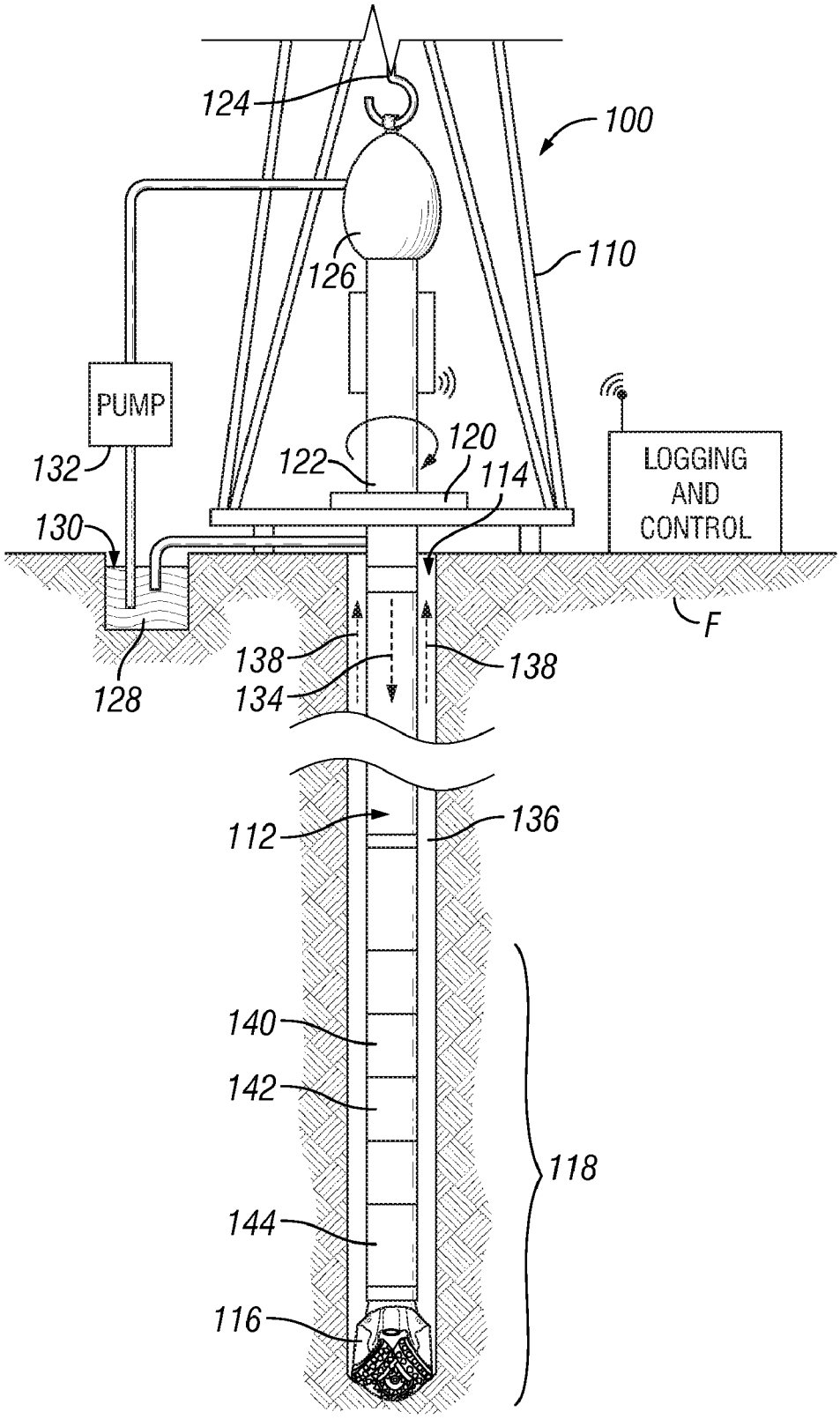
FIG. 1 shows a side view of a wellsite having a drilling rig with a drill string suspended therefrom in accordance with one or more embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring now to FIG. 1, a side view of a wellsite 100 having a drilling rig 110 with a drill string 112 suspended therefrom in accordance with one or more embodiments of the present disclosure is shown. The wellsite 100 shown, or one similar thereto, may be used within onshore and/or offshore locations. In this embodiment, a borehole 114 may be formed within a subsurface formation F, such as by using rotary drilling, or any other method known in the art. As such, one or more embodiments in accordance with the present disclosure may be used within a wellsite, similar to the one as shown in FIG. 1 (discussed more below). Further, those having ordinary skill in the art will appreciate that the present disclosure may be used within other wellsites or drilling operations, such as within a directional drilling application, without departing from the scope of the present disclosure.

Continuing with FIG. 1, the drill string 112 may suspend from the drilling rig 110 into the borehole 114. The drill string 112 may include a bottom hole assembly 118 and a drill bit 116, in which the drill bit 116 may be disposed at an end of the drill string 112. The surface of the wellsite 100 may have the drilling rig 110 positioned over the borehole 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

Further, an upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used in accordance with one or more embodiments without departing from the scope of the present disclosure. In such a top-drive system, the hook 124, swivel 126, and kelly 122 are replaced by a drive motor (electric or hydraulic) that may apply rotary torque and axial load directly to drill string 112.

The wellsite 100 may further include drilling fluid 128 (also known as drilling "mud") stored in a pit 130. The pit 130 may be formed adjacent to the wellsite 100, as shown, in which a pump 132 may be used to pump the drilling fluid 128 into the wellbore 114. In this embodiment, the pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, in this embodiment, the drilling fluid 128 may exit the drill string 112 through one or more ports formed within the drill bit 116.

As such, the drilling fluid 128 may flow back upwardly through the borehole 114, such as through an annulus 136 formed between the exterior of the drill string 112 and the interior of the borehole 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the borehole 114) back to the surface of the wellsite 100. As such, this drilling fluid 128 may be filtered and cleaned and/or returned back to the pit 130 for recirculation within the borehole 114.

Though not shown in this embodiment, the drill string 112 may further include one or more stabilizing collars. A stabilizing collar may be disposed within and/or connected to the drill string 112, in which the stabilizing collar may be used to engage and apply a force against the wall of the borehole 114. This may enable the stabilizing collar to prevent the drill string 112 from deviating from the desired direction for the borehole 114. For example, during drilling, the drill string 112 may "wobble" within the borehole 114, thereby enabling the drill string 112 to deviate from the desired direction of the borehole 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components included therein, such as components to measure, process, and store information. Further, the bottom hole assembly 118 may include components to communicate and relay information to the surface of the wellsite.

As such, in this embodiment shown in FIG. 1, the bottom hole assembly 118 may include one or more logging-while-drilling ("LWD") tools 140 and/or one or more measuring-while-drilling ("MWD") tools 142. Further, the bottom hole assembly 118 may also include a steering-while-drilling system (e.g., a rotary-steerable system) and motor 144, in which the rotary-steerable system and motor 144 may be coupled to the drill bit 116.

The LWD tool 140 shown in FIG. 1 may include a thick-walled housing, commonly referred to as a drill collar, and may include one or more of a number of logging tools known in the art. Thus, the LWD tool 140 may be capable of measuring, processing, and/or storing information therein, as well as capabilities for communicating with equipment disposed at the surface of the wellsite 100.

Further, the MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. As such, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

Figure 2:
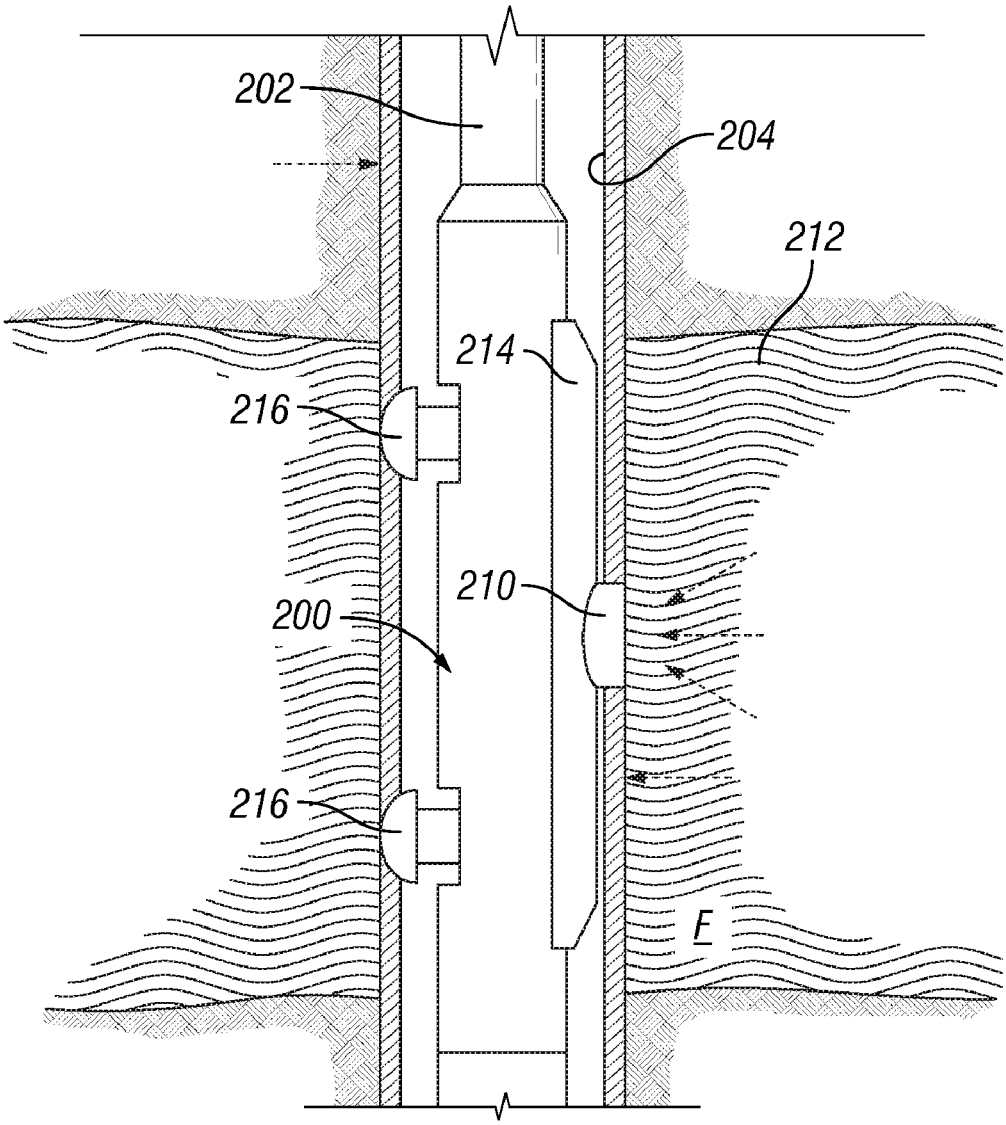
FIG. 2 shows a side view of a tool in accordance with one or more embodiments of the present disclosure.

Referring now to FIG. 2, a side view of a tool 200 in accordance with one or more embodiments of the present disclosure is shown. The tool 200 may be connected to and/or included within a drill string 202, in which the tool 200 may be disposed within a borehole 204 formed within a subsurface formation F. As such, the tool 200 may be included and used within a bottom hole assembly, as described above.

Particularly, in this embodiment, the tool 200 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entireity. As such, the tool 200 may include a probe 210 to hydraulically establish communication with the formation F and draw formation fluid 212 into the tool 200.

In this embodiment, the tool 200 may also include a stabilizer blade 214 and/or one or more pistons 216. As such, the probe 210 may be disposed on the stabilizer blade 214 and extend therefrom to engage the wall of the borehole 204. The pistons, if present, may also extend from the tool 200 to assist probe 210 in engaging with the wall of the borehole 204. In alternative embodiments, though, the probe 210 may not necessarily engage the wall of the borehole 204 when drawing formation fluid 212 from the formation F.

As such, fluid 212 drawn into the tool 200 may be measured to determine one or more parameters of the formation F, such as pressure and/or pretest parameters of the formation F. Additionally, the tool 200 may include one or more devices, such as sample chambers or sample bottles, that may be used to collect formation fluid samples. These formation fluid samples may be retrieved back at the surface with the tool 200. Alternatively, rather than collecting formation fluid samples, the formation fluid 212 received within the tool 200 may be circulated back out into the formation F and/or borehole 204. As such, a pumping system may be included within the tool 200 to pump the formation fluid 212 circulating within the tool 200. For example, the pumping system may be used to pump formation fluid 212 from the probe 210 to the sample bottles and/or back into the formation F.

Figure 3:
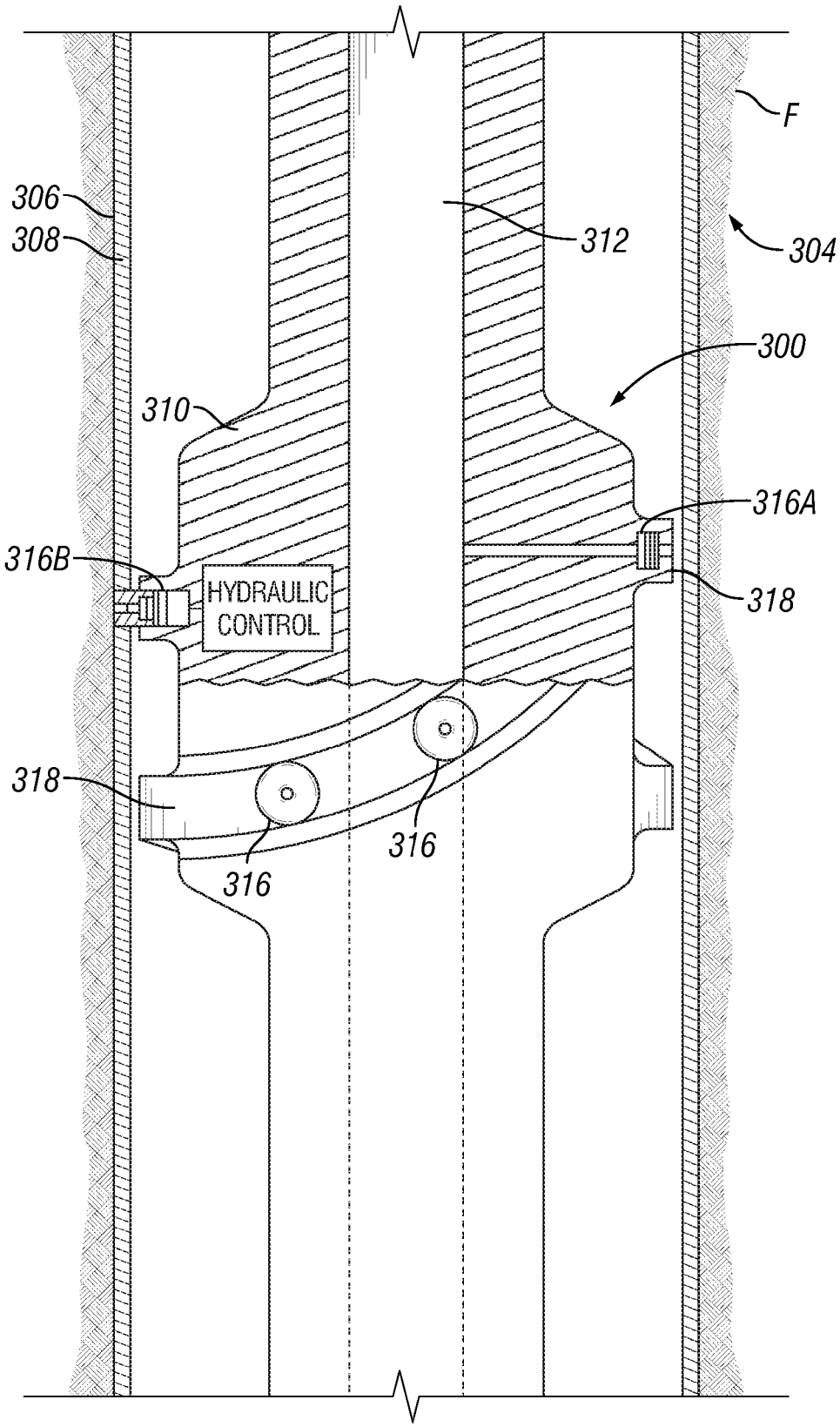
FIG. 3 shows a schematic view of a tool in accordance with one or more embodiments of the present disclosure.

Referring now to FIG. 3, a schematic view of a tool 300 in accordance with one or more embodiments of the present disclosure is shown. The tool 300 may be connected to and/or included within a bottom hole assembly, in which the tool 300 may be disposed within a borehole 304 formed within a subsurface formation F.

In this embodiment, the tool 300 may be a pressure LWD tool used to measure one or more downhole pressures, including annular pressure, formation pressure, and pore pressure, before, during, and/or after a drilling operation. Further, those having ordinary skill in the art will appreciate that other pressure LWD tools may also be utilized in one or more embodiments, such as that described within U.S. Pat. No. 6,986,282, filed on Feb. 18, 2003, entitled "Method and Apparatus for Determining Downhole Pressures During a Drilling Operation," and incorporated herein by reference.

As shown, the tool 300 may be formed as a modified stabilizer collar 310, similar to a stabilizer collar as described above, and may have a passage 312 formed therethrough for drilling fluid. The flow of the drilling fluid through the tool 300 may create an internal pressure $P_1$, and the exterior of the tool 300 may be exposed to an annular pressure $P_A$ of the surrounding borehole 304 and formation F. A differential pressure $P_\delta$ formed between the internal pressure $P_1$ and the annular pressure $P_A$ may then be used to activate one or more pressure devices 316 included within the tool 300.

In this particular embodiment, the tool 300 includes two pressure measuring devices 316A and 316B that may be disposed on stabilizer blades 318 formed on the stabilizer collar 310. The pressure measuring device 316A may be used to measure the annular pressure $P_A$ in the borehole 304, and/or may be used to measure the pressure of the formation F when positioned in engagement with a wall 306 of the borehole 304. As shown in FIG. 3, the pressure measuring device 316A is not in engagement with the borehole wall 306, thereby enabling the pressure measuring device 316A to measure the annular pressure $P_A$, if desired. However, when the pressure measuring device 316A is moved into engagement with the borehole wall 306, the pressure measuring device 316A may be used to measure pore pressure of the formation F.

As also shown in FIG. 3, the pressure measuring device 316B may be extendable from the stabilizer blade 318, such as by using a hydraulic control disposed within the tool 300. When extended from the stabilizer blade 318, the pressure measuring device 316B may establish sealing engagement with the wall 306 of the borehole 304 and/or a mudcake 308 of the borehole 304. This may enable the pressure measuring device 316B to take measurements of the formation F also. Other controllers and circuitry, not shown, may be used to couple the pressure measuring devices 316 and/or other components of the tool 300 to a processor and/or a controller. This processor and/or controller may then be used to communicate the measurements from the tool 300 to other tools within a bottom hole assembly or to the surface of a wellsite. As such, a pumping system in accordance with embodiments disclosed herein may be included within the tool 300, such as including the pumping system within one or more of the pressure devices 316 for activation and/or movement of the pressure devices 316.

Figure 4:
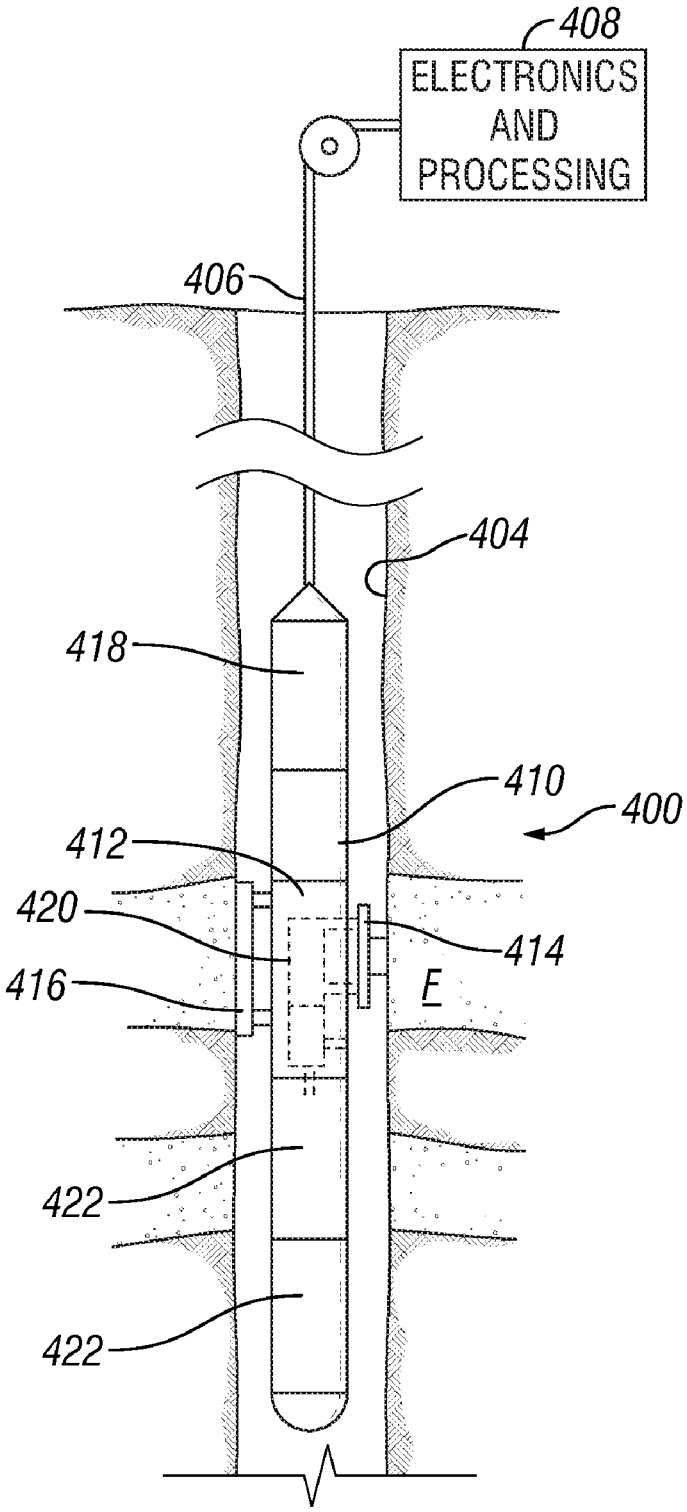
FIG. 4 shows a side view of a tool in accordance with one or more embodiments of the present disclosure.

Referring now to FIG. 4, a side view of a tool 400 in accordance with one or more embodiments of the present disclosure is shown. In this embodiment, the tool 400 may be a "wireline" tool, in which the tool 400 may be suspended within a borehole 404 formed within a subsurface formation F. As such, the tool 400 may be suspended from an end of a multi-conductor cable 406 located at the surface of the formation F, such as by having the multi-conductor cable 406 spooled around a winch (not shown) disposed on the surface of the formation F. The multi-conductor cable 406 is then couples the tool 400 with an electronics and processing system 408 disposed on the surface.

The tool 400 shown in this embodiment may have an elongated body 410 that includes a formation tester 412 disposed therein. The formation tester 412 may include an extendable probe 414 and an extendable anchoring member 416, in which the probe 414 and anchoring member 416 may be disposed on opposite sides of the body 410. One or more other components 418, such as a measuring device, may also be included within the tool 400.

The probe 414 may be included within the tool 400 such that the probe 414 may be able to extend from the body 410 and then selectively seal off and/or isolate selected portions of the wall of the borehole 404. This may enable the probe 414 to establish pressure and/or fluid communication with the formation F to draw fluid samples from the formation F. The tool 400 may also include a fluid analysis tester 420 that is in fluid communication with the probe 414, thereby enabling the fluid analysis tester 420 to measure one or more properties of the fluid. The fluid from the probe 414 may also be sent to one or more sample chambers or bottles 422, which may receive and retain fluids obtained from the formation F for subsequent testing after being received at the surface. The fluid from the probe 414 may also be sent back out into the borehole 404 or formation F. As such, a pumping system may be included within the tool 400 to pump the formation fluid circulating within the tool 400. For example, the pumping system may be used to pump formation fluid from the probe 414 to the sample bottles 422 and/or back into the formation F.

Figure 5:
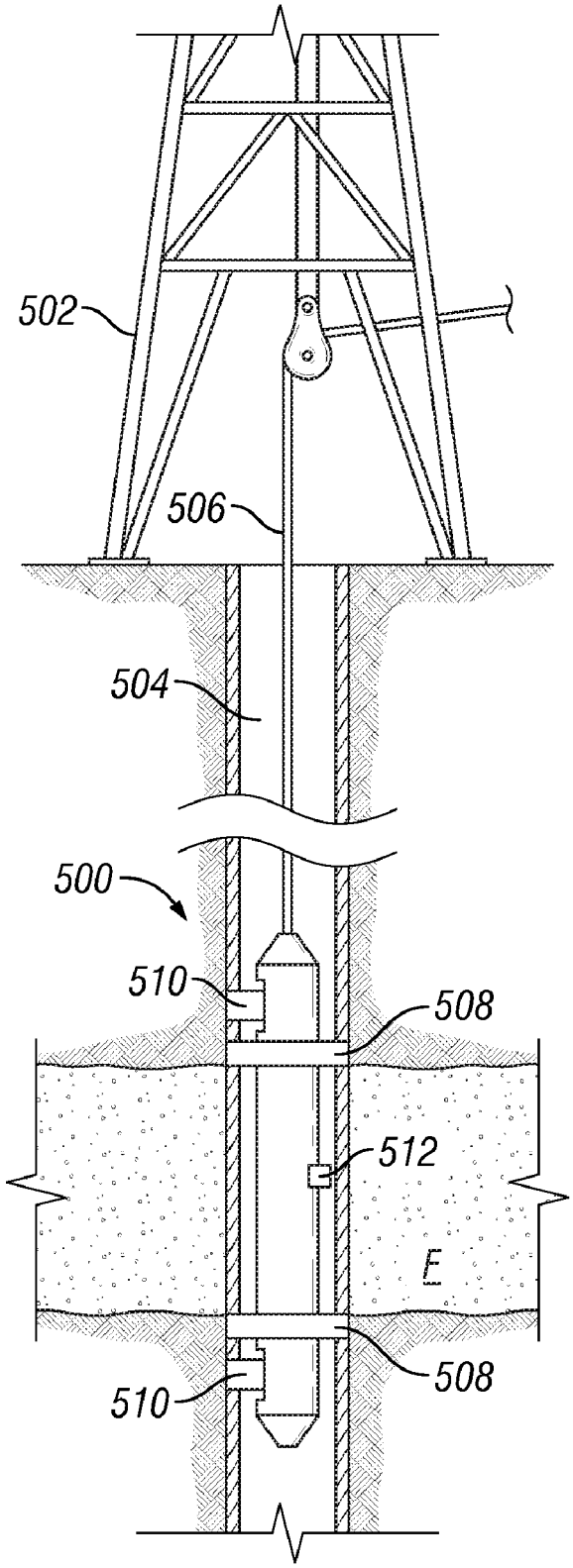
FIG. 5 shows a side view of a tool in accordance with one or more embodiments of the present disclosure.

Referring now to FIG. 5, a side view of another tool 500 in accordance with one or more embodiments of the present disclosure is shown. Similar to the above embodiment in FIG. 4, the tool 500 may be suspended within a borehole 504 formed within a subsurface formation F using a multi-conductor cable 506. In this embodiment, the multi-conductor cable 506 may be supported by a drilling rig 502.

As shown in this embodiment, the tool 500 may include one or more packers 508 that may be configured to inflate, thereby selectively sealing off a portion of the borehole 504 for the tool 500. Further, to test the formation F, the tool 500 may include one or more probes 510, and the tool 500 may also include one or more outlets 512 that may be used to inject fluids within the sealed portion established by the packers 508 between the tool 500 and the formation F. As such, similar to the above embodiments, a pumping system may be included within the tool 500 to pump fluid circulating within the tool 500. For example, the pumping system may be used to selectively inflate and/or deflate the packers 508, in addition to pumping fluid out of the outlet 512 into the sealed portion formed by the packers 508.

Figure 6:
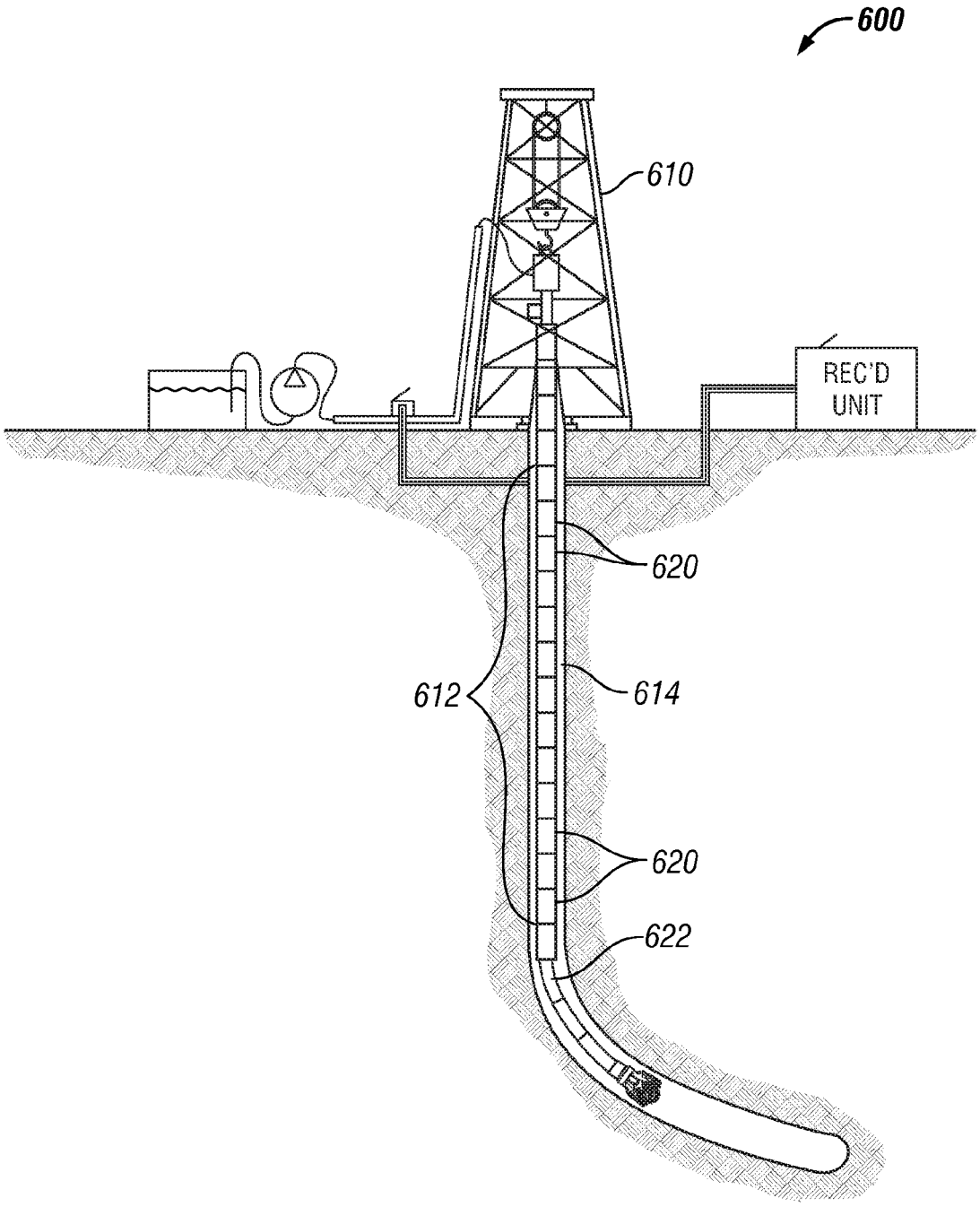
FIG. 6 shows a side view of a wellsite having a drilling rig in accordance with one or more embodiments of the present disclosure.

Referring now to FIG. 6, a side view of a wellsite 600 having a drilling rig 610 in accordance with one or more embodiments of the present disclosure is shown. In this embodiment, a borehole 614 may be formed within a subsurface formation F, such as by using a drilling assembly, or any other method known in the art. Further, in this embodiment, a wired pipe string 612 may be suspended from the drilling rig 610. The wired pipe string 612 may be extended into the borehole 614 by threadably coupling multiple segments 620 (i.e., joints) of wired drill pipe together in an end-to-end fashion. As such, the wired drill pipe segments 620 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. Further, the wired drill pipe may include having a form of signal coupling, such as having inductive coupling, to communicate data and/or signals between adjacent pipe segments assembled together.

As such, the wired pipe string 612 may include one or more tools 622 and/or instruments disposed within the pipe string 612. For example, as shown in FIG. 6, a string of multiple borehole tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation F.

The tools 622 may be connected to the wired pipe string 612 during drilling the borehole 614, or, if desired, the tools 622 may be installed after drilling the borehole 614. If installed after drilling the borehole 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the borehole 614. The tools 622 may then be positioned within the borehole 614, as desired, through the selective movement of the wired pipe string 612, in which the tools 622 may gather measurements and data. These measurements and data from the tools 622 may then be transmitted to the surface of the borehole 614 using the cable within the wired drill pipe 612. As such, a pumping system in accordance with embodiments disclosed herein may be included within the wired drill pipe 612, such as by including the pumping system within one or more of the tools 622 of the wired drill pipe 612 for activation and/or measurement purposes.

As discussed above, a pumping system in accordance with the present disclosure may be included within one or more of the embodiments shown in FIGS. 1-6, in addition to being included within other tools and/or devices that may be disposed downhole within a formation. The pumping system, thus, may be used within a tool to provide a relatively larger range of flow rates, as compared to one or more traditional pumping systems. For example, as shown above with respect to FIGS. 1-6, a pumping system may be used within a number of embodiments. As such, a pumping system having a relatively lower flow rate may be desired for one embodiment, whereas a pumping system having a relatively higher flow rate may be desired for another embodiment. However, one or more of the traditional pumping systems may be able to provide only one of these higher or lower flow rates, thereby not enabling the traditional pumping system to be used within both the higher and lower flow rate embodiments.

Thus, in accordance with the present disclosure, embodiments disclosed herein generally relate to a pumping system that may be used within a downhole tool, such as a tool provided within one or more of the embodiments shown in FIGS. 1-6, in addition to being included within other tools and/or devices that may be disposed downhole. The pumping system may include a displacement unit, a hydraulic driving device, and a mechanical driving device. The displacement unit may have at least one cavity formed therein, the cavity being able to receive fluid therein. Each of the hydraulic driving device and the mechanical driving device may be configured to couple to the displacement unit. When coupled to the displacement unit, the hydraulic driving device and/or the mechanical driving device may be able to drive the displacement unit such that the fluid is received within the cavity of the displacement unit. As such, though both the hydraulic driving device and the mechanical driving device are configured to couple to the displacement unit to drive the displacement unit, only one of the hydraulic driving device and the mechanical driving device needs to be coupled to the displacement unit to drive the displacement unit.

For example, in one embodiment, the hydraulic driving device may be coupled to the displacement unit while the mechanical driving device may be de-coupled from the displacement unit. This embodiment enables the hydraulic driving device then to be able to drive the displacement unit to have the fluid received within the cavity. In another embodiment, the mechanical driving device may be coupled to the displacement unit while the hydraulic driving device may be de-coupled from the displacement unit. This embodiment enables the mechanical driving device then to be able to drive the displacement unit to have the fluid received within the cavity. As such, though both the hydraulic driving device and the mechanical driving device are configured to couple to the displacement unit to drive the displacement unit, only one of the driving devices may be coupled to the displacement unit at any one time to drive the displacement unit. However, in other embodiments, both the hydraulic driving device and the mechanical driving device may be coupled to the displacement unit to drive the displacement unit.

A displacement unit in accordance with one or more embodiments of the present disclosure may include a housing having a chamber formed therein. A piston may then be disposed within this chamber, thereby forming a first cavity and a second cavity within the chamber. Further, the housing may also have a second chamber formed therein, if desired. As such, a second piston may be disposed within the second chamber, thereby forming a third cavity and a fourth cavity within the second chamber. The first piston and the second piston of the displacement unit may be connected to each other, so as to enable the first and second pistons to move in sequence with each other.

A hydraulic driving device in accordance with one or more embodiments of the present disclosure may include a hydraulic pump, in which the hydraulic pump may be used to pump fluid into one of the cavities of the displacement unit. Further, a switch valve may be coupled between the hydraulic pump and displacement unit, in which the switch valve may be used to selectively pump fluid into one or more cavities of the displacement unit, as desired.

A mechanical driving device in accordance with one or more embodiments of the present disclosure may include a roller screw, in which the roller screw may be used to couple with one of the pistons of the displacement unit. Further, a latching mechanism may be coupled between the roller screw and displacement unit, in which the latching mechanism may be used to selectively couple the roller screw with the piston of the displacement unit, as desired.

Further, a motor may be coupled to one or both of the hydraulic driving device and the mechanical driving device. The motor may be used to provide power to the hydraulic driving device and/or the mechanical driving device. As such, multiple motors may be provided for powering each of the hydraulic driving device and the mechanical driving device, or a single motor may be provided for powering both the hydraulic driving device and the mechanical driving device.

Figure 7A:
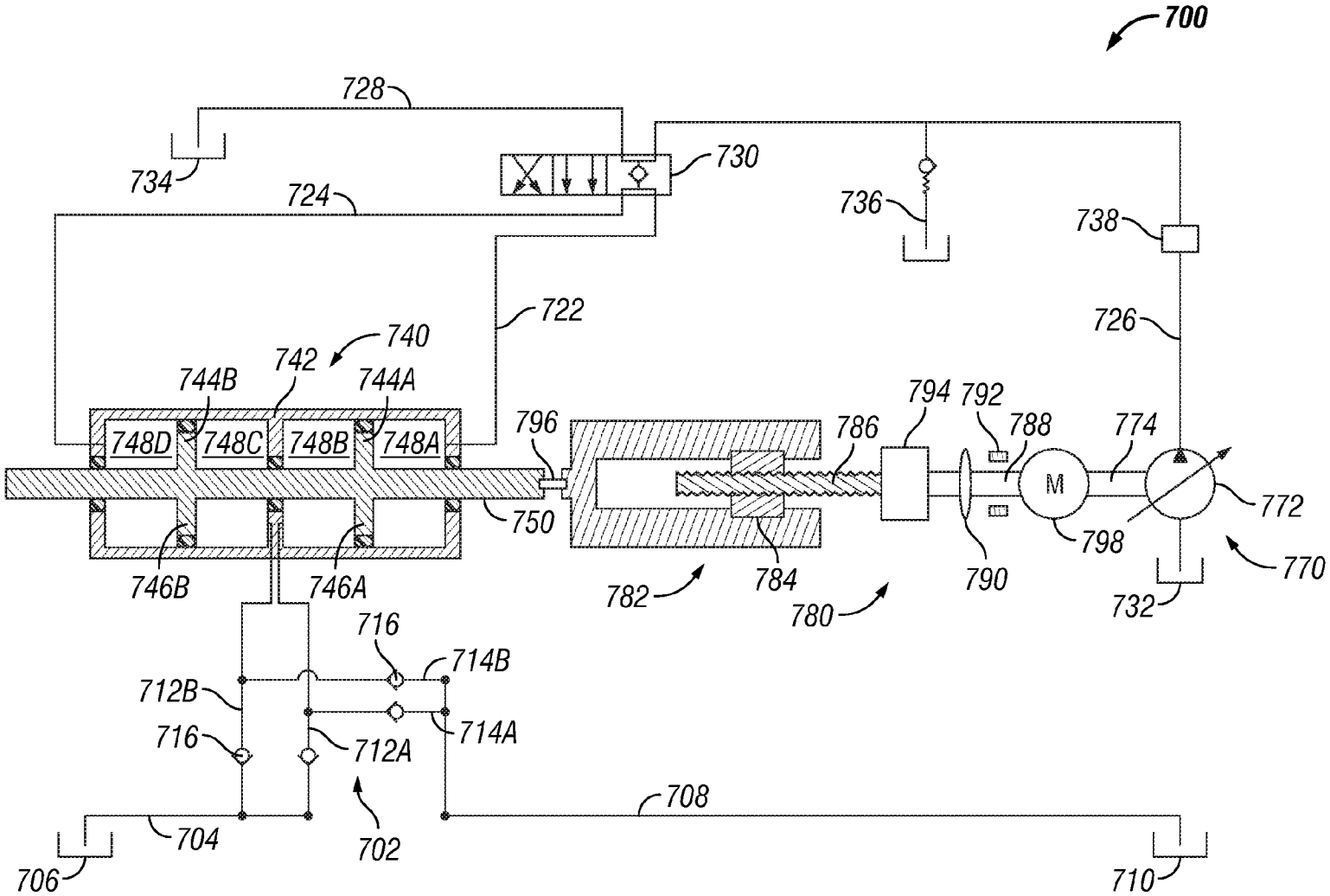
FIGS. 7A and 7B show multiple schematic views of a pumping system in accordance with one or more embodiments of the present disclosure.
Figure 7B:
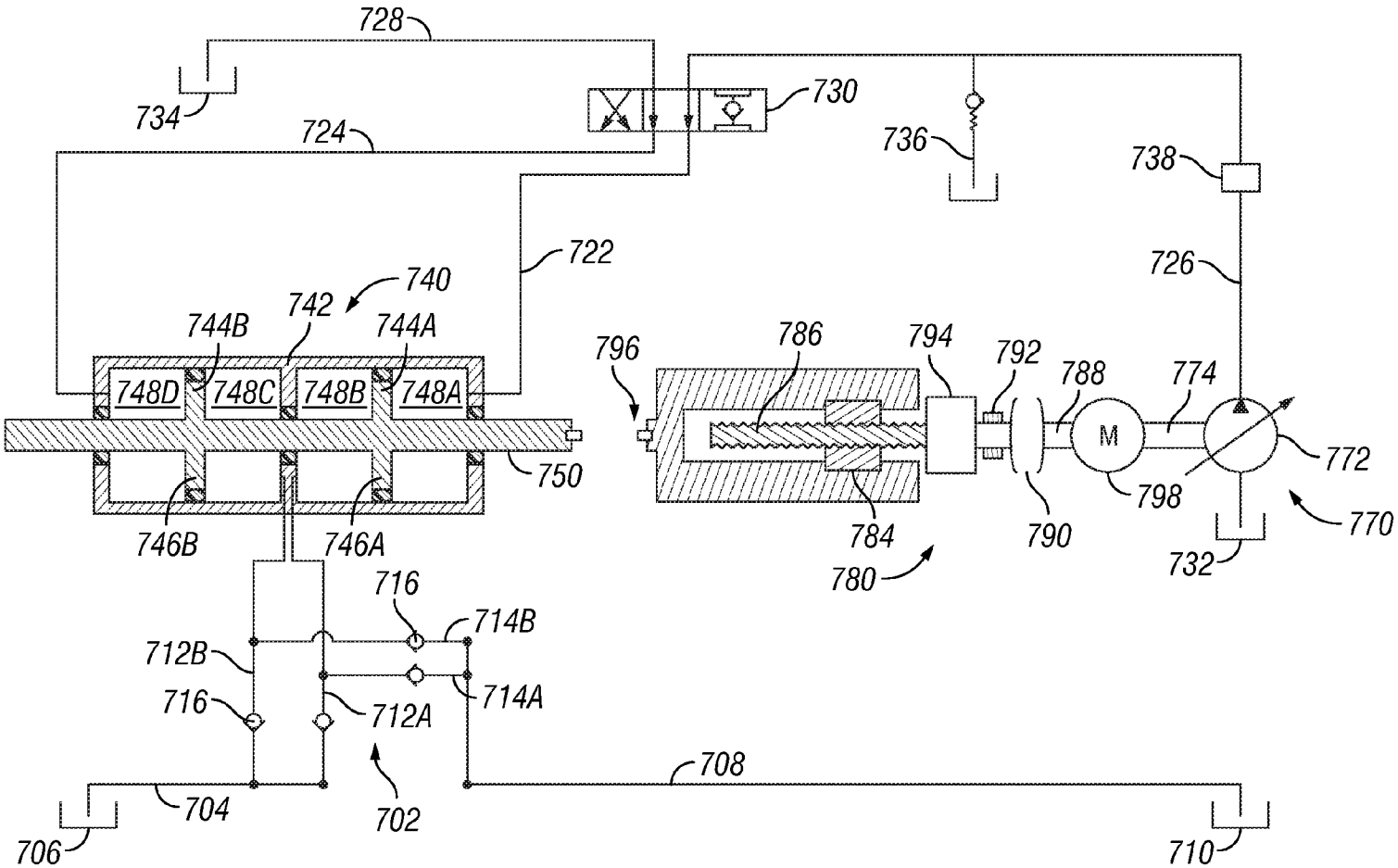

Referring now to FIGS. 7A and 7B, multiple schematic views of a pumping system 700 in accordance with one or more embodiments of the present disclosure are shown. The pumping system 700 may include a displacement unit 740, as shown, in addition to a hydraulic driving device 770 and a mechanical driving device 780. As discussed above and as shown, both the hydraulic driving device 770 and the mechanical driving device 780 may be configured to couple to the displacement unit 740. However, though both the hydraulic driving device 770 and the mechanical driving device 780 are configured to couple to the displacement unit 740, FIG. 7A shows only the mechanical driving device 780 coupled to the displacement unit 740 with the hydraulic driving device 770 de-coupled from the displacement unit 740, and FIG. 7B shows only the hydraulic driving device 770 coupled to the displacement unit 740 with the mechanical driving device 780 de-coupled from the displacement unit 740 (discussed more below).

When coupled to the displacement unit 740, both the hydraulic driving device 770 and the mechanical driving device 780 may be able to drive the displacement unit 740, thereby enabling the displacement unit 740 to receive and displace one or more fluids while being driven. As shown, the displacement unit 740 includes a housing 742, in which one or more chambers 744 may be formed within the housing 742. In this embodiment, the housing 742 has two chambers 744A and 744B formed therein; those having ordinary skill in the art, though, will appreciate that the displacement unit may be formed with only one chamber, or may be formed with more than two chambers, such as by having three or four chambers formed therein.

Further, the displacement unit 740 may have one or more pistons 746 disposed therein, such as by having a piston 746 disposed within each chamber 744 of the housing 742. As such, in the embodiment shown in FIGS. 7A and 7B, the displacement unit 740 includes two pistons 746A and 746B, in which one piston 746A may be disposed within one chamber 744A, and the other piston 746B may be disposed within the other chamber 744B. With this arrangement, the piston 746A may define two cavities 748A and 748B within the chamber 744A, one cavity 748A and 748B on each side of the piston 746A, and the piston 746B may define another two cavities 748C and 748D within the chamber 744B, one cavity 748C and 748D on each side of the piston 746B. If desired, the pistons 746A and 746B may also be coupled to each other, such as by having a shaft 750 connecting the pistons 746A and 746B to each other. Furthermore, those having ordinary skill in the art will appreciate that, though the displacement unit is shown having two pistons, other arrangements for the displacement unit may be used without departing from the present disclosure. For example, in one embodiment, the displacement unit may include only one piston, whereas in another embodiment, the displacement unit may include more than two pistons.

The cavities 748A-D may be formed within the displacement unit 740 such that fluid may be received therein. Further, the pistons 746A and 746B may be formed and disposed within the chambers 744A and 744B, respectively, such that the pistons 746A and 746B may be able to move from side-to-side within the chambers 744A and 744B. As such, when the displacement unit 740 is driven, the cavities 748A-D may be able to compliment each other as fluid is received into each of the respective cavities 748A-D.

For example, in the chamber 744A, the cavity 748A and 748B may be able to compliment each other as the displacement unit 740 is being driven and the piston 746A is moving within the chamber 744A. As shown in FIGS. 7A and 7B, the piston 746A is shown as substantially center within the chamber 744A. However, when the displacement unit 740 is driven, the piston 746A will then either move to the left or to the right within the chamber 744A. Assuming the piston 746A is moving to the left, the cavity 748A will increase in volume and will be able to receive more fluid therein, while the cavity 748B will decrease in volume and will be able to displace fluid therefrom.

Conversely, assuming the piston 746A is moving to the right, the cavity 748B will increase in volume and will be able to receive more fluid therein, while the cavity 748A will decrease in volume and will be able to displace fluid therefrom. As such, by selectively moving the piston 746A to the left or right within the chamber 744A, the displacement unit 740 may be used to selectively displace fluid from one of the cavities 748A and 748B while receiving fluid within the other of the cavities 748A and 748B. The piston 744B may then be used in a similar fashion to that of piston 746A, in which by selectively moving the piston 746B to the left or right within the chamber 744B, the displacement unit 740 may be used to selectively displace fluid from one of the cavities 748C and 748D while receiving fluid within the other of the cavities 748C and 748D.

The displacement unit 740 may then be used to receive one or more fluids therein. In the embodiment shown in FIGS. 7A and 7B, the displacement unit 740 is arranged to receive two fluids therein. However, those having ordinary skill in the art will appreciate that the present disclosure is not so limited, as other embodiments may arranged to receive only one fluid therein, or may be arranged to receive more than two fluids therein.

Continuing, the displacement unit 740 is arranged in this embodiment to receive one fluid within chambers 748A and 748D, while receiving another fluid within chambers 748B and 748C. For example, as shown, a valve block 702 may be fluidly coupled to the displacement unit 740. The valve block 702 may include inlet flow lines 704, 712A, and 712B, and may also include outlet flow lines 708, 714A, and 714B. The inlet flow lines 704, 712A, and 712B may be fluidly coupled to a fluid reservoir 706, and the outlet flow lines 708, 714A, and 714B may be fluidly coupled to a fluid reservoir 710.

As such, the valve block 702 may provide fluid from the fluid reservoir 706 to the cavity 748B using inlet flow lines 704 and 712A and may provide fluid from the fluid reservoir 706 to the cavity 748C using inlet flow lines 704 and 712B. Further, the valve block 702 may withdraw fluid from the cavity 748B to the fluid reservoir 710 using outlet flow lines 708 and 714A and may withdraw fluid from the cavity 748C to the fluid reservoir 710 using outlet flow lines 708 and 714B. One or more valves 716 may be used within the valve block 702 to then control the flow of the fluid through the valve block 702. The valves 716 may be check valves, active valves, and/or any other valves known in the art to control fluid through the valve block 702.

For example, in one embodiment, in which one or more of the valves 716 includes a check valve, the check valve may be configured to operate in a first fluid flow direction and a second (i.e., a reverse) fluid flow direction. In such an embodiment, the check valve may enable fluid flow therethrough in the first direction, and then may be switched such as to enable fluid flow therethrough in the second (i.e., the reverse) direction. In another embodiment, in which one or more of the valves 716 includes an active valve, the active valve may be configured to selectively open and close, thereby enabling fluid flow therethrough in both directions, when open, and inhibiting fluid flow therethrough in both directions, when closed. As such, the valves 716 within the fluid block 702 may be selectively operated and/or controlled, such as by a controller, such that the fluid block 702 may be fluidly coupled to and used with the displacement unit 740 to enable fluid to be received and displaced by the displacement unit 740 in a first fluid flow direction and/or a second fluid flow direction.

Further, the cavity 748A may have a flow line 722 extending therefrom, and the cavity 748D may have a flow line 724 extending therefrom. As shown in FIG. 7A, the flow lines 722 and 724 may be fluidly coupled to each other through a switch valve 730. This arrangement of the flow lines 722 and 724 in FIG. 7A may enable the cavities 748A and 748D to fluidly couple to each other. Alternatively, as shown in FIG. 7B, the switch valve 730 may switch to a second position to fluidly couple the flow line 722 to the flow line 726, and fluidly couple the flow line 724 to the flow line 728. Further, in another arrangement (not shown), the switch valve 730 may switch again to a third position to fluidly couple the flow line 722 to the flow line 728, and fluidly couple the flow line 724 to the flow line 726.

As such, as discussed above, the mechanical driving device 780 may be coupled to the displacement unit 740 in FIG. 7A to drive the displacement unit 740. In this embodiment, the mechanical driving device 780 may include a roller screw 782, in which the roller screw 782 may include a nut 784 and a threaded shaft 786. The mechanical driving device 780 may have power provided thereto by a motor 798, such as by having the motor 798 power a shaft 788. The shaft 788 may be coupled to the threaded shaft 786 using a clutch 790, thereby enabling the clutch 790 to engage and disengage the shaft 788 and the threaded shaft 786 from each other, as desired. Further, a brake 792 may be included within the mechanical driving device 780 to stop the rotation of the shaft 788, if desired, and a gear box 794 may also be included within the mechanical driving device 780 to modify the ratio and/or direction of rotation translated between the shaft 788 and the threaded shaft 786, if desired.

To drive the displacement unit 740 with the mechanical driving device 780, the mechanical driving device 780 may be coupled to the displacement unit 740 using, for example, a latching mechanism 796. In this embodiment, the latching mechanism 796 may be disposed between the mechanical driving device 780 and the displacement unit 740, in which the latching mechanism 796 may particularly couple the roller screw 782 of the mechanical driving device 780 to the shaft 750 of the displacement unit 740. The latching mechanism 796 may be used to selectively couple the mechanical driving device 780 and the displacement unit 740, thereby enabling the mechanical driving device 780 to drive the displacement unit 740 during selected times. As such, the latching mechanism 796 may be hydraulically, mechanically, magnetically, and/or electrically actuated to selectively couple the mechanical driving device 780 and the displacement unit 740.

When the mechanical driving device 780 is coupled to the displacement unit 740, as shown in FIG. 7A, the mechanical driving device 780 may drive the displacement unit 740, such as by having the motor 798 power the mechanical driving device 780. As shown in this embodiment, the motor 798 may power the shaft 788, in which the shaft 788 is coupled to the threaded shaft 786 of the roller screw 782 through the clutch 790 and gear box 794. As the threaded shaft 786 is powered and rotated by the motor 798, the nut 784 will then move in either one of the left or right direction, depending on the rotation of the threaded shaft 786. Alternatively, a multi-helical threaded shaft (not shown) may be used in place of the threaded shaft 786 such that the entire left-to-right stroke of the nut 784 of the roller screw 782 may be accomplished with the motor 798 turning in a single direction. Advantageously, such a multi-helical (i.e., bi-directional) threaded shaft would reduce or eliminate the need for controller logic to reverse the motor 798 at the end of a left-approaching or right-approaching stroke of the nut 784.

If the mechanical driving device 780 moves in the left direction, this will move the shaft 750, and subsequently the pistons 746A and 746B, also to the left. As the pistons 746A and 746B move to the left, this will enable the cavities 748A and 748C to receive fluid therein, and will enable the cavities 748B and 748D to displace fluid therefrom. Particularly, as shown, fluid from the cavity 748D will be displaced through the flow lines 724 and 722 and received into the cavity 748A. Further, fluid from the cavity 748B will be displaced through the outlet flow lines 708 and 714A to the fluid reservoir 710, while fluid will be received within the cavity 748C through the inlet flow lines 704 and 712B from the fluid reservoir 706.

If the mechanical driving device 780 moves in the right direction, this will move the shaft 750, and subsequently the pistons 746A and 746B, also to the right. As the pistons 746A and 746B move to the right, this will enable the cavities 748B and 748D to receive fluid therein, and will enable the cavities 748A and 748C to displace fluid therefrom. Particularly, as shown, fluid from the cavity 748A will be displaced through the flow lines 722 and 724 and received into the cavity 748D. Further, fluid from the cavity 748C will be displaced through the outlet flow lines 708 and 714B to the fluid reservoir 710, while fluid will be received within the cavity 748B through the inlet flow lines 704 and 712A from the fluid reservoir 706.

Continuing, as discussed above, the hydraulic driving device 770 may be coupled to the displacement unit 740 in FIG. 7B to drive the displacement unit 740. In this embodiment, the hydraulic driving device 770 may include may include a hydraulic pump 772, such as a variable hydraulic pump or any other pump known in the art, in which the hydraulic pump 772 may be fluidly coupled between a fluid reservoir 732 and the flow line 726. The hydraulic driving device 770 may have power provided thereto by the motor 798, such as by having the motor power a shaft 774, in which the shaft 774 may be coupled to the hydraulic pump 772 to power the hydraulic pump 772.

To drive the displacement unit 740 with the hydraulic driving device 770, the hydraulic driving device 780 may be coupled to the displacement unit 740 using, for example, the switch valve 730. Further, if desired, the latching mechanism 796 may be disengaged, as shown in FIG. 7B, to de-couple the mechanical driving device 780 from the displacement unit 740, as compared to having the latching mechanism 796 engaged, as shown in FIG. 7A, to couple the mechanical driving device 780 with the displacement unit 740. Furthermore, the clutch 790 may be opened to decouple the shaft 790 from the roller screw 780, and the brake 792 may also be applied to the shaft 786.

When the hydraulic driving device 770 is coupled to the displacement unit 740, as shown in FIG. 7B, the hydraulic driving device 770 may drive the displacement unit 740, such as by having the motor 798 power the hydraulic driving device 770. As shown in this embodiment, the motor 798 may power the shaft 774, in which the shaft 774 is coupled to the hydraulic pump 772. As the shaft 774 is powered and rotated by the motor 798, the hydraulic pump 772 may then pump fluid from the fluid reservoir 732 to the displacement unit 740 through the flow line 726 and through the switch valve 730 to either the flow line 722 or flow line 724.

In FIG. 7B, when the switch valve 730 is in the position to fluidly couple the flow lines 726 and 722, the hydraulic driving device 770 may pump fluid through the flow lines 726 and 722 into the cavity 748A. As fluid is received within the cavity 748A, this will subsequently move the pistons 746A and 746B to the left, as the pistons 746A and 746B have a fluid pressure applied thereto from the hydraulic driving device 770. As the pistons 746A and 746B move to the left, this will enable the cavity 748C to also receive fluid therein, and will enable the cavities 748B and 748D to displace fluid therefrom. Particularly, as shown, fluid from the cavity 748D will be displaced through the flow lines 724 and 728 fluidly coupled to each other to a fluid reservoir 734 fluidly coupled to the flow line 728. Further, fluid will be received within the cavity 748C through inlet flow lines 704 and 712B from the fluid reservoir 706, and fluid from the cavity 748B will be displaced through the outlet flow lines 708 and 714A to the fluid reservoir 710.

When the switch valve 730 is in the position to fluidly couple the flow lines 726 and 724, the hydraulic driving device 770 may pump fluid through the flow lines 726 and 724 into the cavity 748D. As fluid is received within the cavity 748D, this will subsequently move the pistons 746A and 746B to the right, as the pistons 746A and 746B have a fluid pressure applied thereto from the hydraulic driving device 770. As the pistons 746A and 746B move to the right, this will enable the cavity 748B to also receive fluid therein, and will enable the cavities 748A and 748C to displace fluid therefrom. Particularly, fluid from the cavity 748A will be displaced through the flow lines 722 and 728 fluidly coupled to each other to the fluid reservoir 734. Further, fluid will be received within the cavity 748B through inlet flow lines 704 and 712A from the fluid reservoir 706, and fluid from the cavity 748C will be displaced through the outlet flow lines 708 and 714B to the fluid reservoir 710. As such, the switch valve 730 may be a three-way switch valve, in which the switch valve 730 may be arranged in at least three different positions, as discussed above, to selectively drive the displacement unit 740 with the hydraulic driving device 770 and/or the mechanical driving device 780.

As such, a pumping system in accordance with embodiments disclosed herein may use a hydraulic driving device and/or a mechanical driving device to couple to and drive a displacement unit. For example, in an embodiment in which the mechanical driving device is desired to be coupled to and drive the displacement unit, the pumping system 700 may be arranged as shown in FIG. 7A to couple the mechanical driving device 780 to the displacement unit 740. The mechanical driving device 780 may then drive the displacement unit 740, such as to have the pistons 744A and 744B reciprocate back-and-forth, to pump fluid from the fluid reservoir 706 to the fluid reservoir 710.

Further, in an embodiment in which the hydraulic driving device is desired to drive the displacement unit, the pumping system 700 may be arranged as shown in FIG. 7B to couple the hydraulic driving device 770 to the displacement unit 740. The hydraulic driving device 770 may then drive the displacement unit 740, such as to have the pistons 744A and 744B reciprocate back-and-forth when alternating positions on the switch valve 730, to pump fluid from the fluid reservoir 706 to the fluid reservoir 710. Also, it should be noted that the hydraulic driving device 770 may also pump fluid from the fluid reservoir 732 to the fluid reservoir 734. As such, the fluid reservoirs 732 and 734 may be fluidly coupled to each other, or may be the same reservoir, to have the fluid re-circulate through the hydraulic driving device 770, if desired.

Furthermore, in an embodiment in which both the mechanical driving device and the hydraulic driving device are desired to drive the displacement unit, the pumping system 700 may be arranged similar to that as shown in FIG. 7B and described from driving the pumping system 700 with the hydraulic driving device 770. However, rather than as shown in FIG. 7B, in this arrangement instead, the latching mechanism 796 may be engaged to couple the mechanical driving device 780 to the displacement unit 740, the clutch 790 may be closed to engage the shaft 788 with the roller screw 784, and the brake 792 may be opened. In such an embodiment, this may enable both the mechanical driving device 780 and the hydraulic driving device 770 to be coupled to and drive the displacement unit 740.

As discussed above, one or more fluids may be used within the pumping system in accordance with embodiments disclosed herein. As such, in the embodiment shown in FIGS. 7A and 7B, the pumping system 700 may have two fluids used therein, in which the fluid reservoirs 706 and 710 use one fluid, and the fluid reservoirs 732 and 734 use another fluid. Thus, in one embodiment, the fluid reservoirs 706 and 710 may use a fluid to be pumped by the pumping system 700, such as by using a formation fluid to pump the formation fluid from the fluid reservoir 706 and to the fluid reservoir 710. This embodiment may be particularly used within a downhole tool, such as when receiving a fluid from a probe, packer, and/or other device within a downhole tool (disposed at the fluid reservoir 706), and the pumping the fluid to a sampling bottle, to the formation, a packer, and/or other device within a downhole tool (disposed at the fluid reservoir 710). Further, the fluid reservoirs 732 and 734 may use a fluid to be within the pumping system 700, such as a working fluid (e.g., hydraulic fluid), that may be used to re-circulate and lubricate one or more components of the pumping system 700.

In an embodiment in which the mechanical driving device is coupled to and driving the displacement unit, the pumping system may have a relatively lower flow rate, whereas in an embodiment in which the hydraulic driving device is coupled to and driving the displacement unit, the pumping system may have a relatively higher flow rate. For example, a flow rate range for the pumping system when being driven by the mechanical driving device may be between about 0.1-40 cc/s (about 0.061-2.4 $in^3/s$), whereas a flow rate range the pumping system when being driven by the hydraulic driving device may be between 1-150 cc/s (about 0.61-9.2 $in^3/s$). Further, in an embodiment in which both the mechanical driving device and the hydraulic driving device are driving the pumping system, the pumping system may have a flow rate over about 150 cc/s (about 9.2 $in^3/s$). As such, as the pumping system may be used within a downhole tool, the displacement unit may be designed such that with each stroke of the displacement unit, the displacement unit may be able to displace about 500 cc (about 30.5 $in^3$). However, those having ordinary skill in the art will appreciate that the present disclosure is not limited to the ranges and measurements described above, as the pumping system may be modified to obtain any desired flow rate and stroke displacement.

As shown above with respect to FIGS. 7A and 7B, one motor is shown to power the hydraulic driving device and the mechanical driving device. However, the present disclosure is not so limited, as two motors may instead by used, in which one motor may be used to power the hydraulic driving device, and the other motor may be used to power the mechanical driving device. Further, the motor may be a bi-directional motor, to rotate the shafts coupled thereto in both directions, or the motor may be a single directional motor. Furthermore, the motor may be a mud motor, electrical motor, or any other motor known in the art to power the hydraulic driving device and the mechanical driving device.

One or more relief valves may be included within the pumping system and fluidly coupled to one or more components of the pumping system. For example, as shown in FIGS. 7A and 7B, a relief valve 736 is fluidly coupled to the flow line 726, thereby providing fluid relief to the flow line 726. As such, one or more other relief valves may be included within the pumping system to provide fluid relief thereto, as desired.

Further, one or more sensors may be included within the pumping system to measure one or more characteristics of the pumping system. For example, as shown in FIGS. 7A and 7B, a sensor 738 may be fluidly coupled to the flow line 726, thereby enabling the sensor 738 to measure characteristics of the flow line 726. As such, one or more sensors may be included within the pumping system to measure pressure, temperature, flow rate, viscosity, and/or any other characteristic of the pumping system known in the art.

Furthermore, in accordance with one or more embodiments of the present disclosure, one or more controllers (not shown) may be used with the pumping system. A controller may be operatively coupled to one or more components of the pumping system to receive feedback from the components and/or to control the components. For example, the controller may be operatively coupled to the switch valve, the gear box, the motor, the clutch, the brake, the hydraulic motor, the valves, the relief valves, the sensors, and/or any other components of the pumping system.

Embodiments disclosed herein may provide for one or more of the following advantages. A pumping system in accordance with the present disclosure may be included within one or more of the embodiments shown in FIGS. 1-6, in addition to being included within other tools and/or devices that may be disposed downhole within a formation. The pumping system, thus, may be used within a tool to provide a relatively larger range of flow rates, as compared to one or more traditional pumping systems. For example, a pumping system in accordance with embodiments disclosed herein may have a relatively larger range of rates, as compared to traditional pumping system having only a hydraulic driving device or a mechanical driving device. Further, a pumping system in accordance with the present disclosure may provide redundancy within the pumping system. For example, if either of the hydraulic driving device or the mechanical driving device fails, the other of the hydraulic driving device and the mechanical driving device may be used, at least temporarily, to drive the pumping system.

In accordance with another aspect of the present disclosure, one or more embodiments disclosed herein relate to a pumping system to be used within a downhole tool. The system includes a displacement unit having a cavity formed therein, the cavity configured to receive a fluid therein, a hydraulic driving device configured to drive a piston of the displacement unit such that the fluid is received within the cavity, and a mechanical driving device configured to drive the piston of the displacement unit such that the fluid is received within the cavity.

In accordance with another aspect of the present disclosure, one or more embodiments disclosed herein relate to another pumping system to be used within a downhole tool. The pumping system includes a displacement unit comprising a chamber with a piston disposed therein, the piston defining a first cavity and a second cavity within the first chamber, a hydraulic pump configured to couple with the displacement unit using a switch valve, in which the hydraulic pump is configured to pump hydraulic fluid into the first cavity of the displacement unit, and a roller screw configured to selectively couple with the piston of the displacement unit through a latching mechanism, in which the roller screw is configured, when latched, to drive the piston such that hydraulic fluid is received within the first cavity of the displacement unit. The pumping system further includes a motor coupled to at least one of the hydraulic pump and the roller screw, in which the motor is configured to provide power to the at least one of the hydraulic pump and the roller screw, and a valve block fluidly coupled to the second cavity of the displacement unit, in which the valve block is configured to selectively direct the formation fluid to the second cavity of the displacement unit.

In accordance with another aspect of the present disclosure, one or more embodiments disclosed herein relate to a method to manufacture a pumping system to be used within a downhole tool. The method includes providing a displacement unit having a cavity formed therein, the cavity configured to receive a fluid therein, configuring a hydraulic driving device to couple to the displacement unit, in which, when coupled to the displacement unit, the hydraulic driving device drives the displacement unit such that the fluid is received within the cavity, and configuring a mechanical driving device to couple to the displacement unit, in which, when coupled to the displacement unit, the mechanical driving device drives the displacement unit such that the fluid is received within the cavity. The method further includes selectively coupling at least one of the hydraulic driving device and the mechanical driving device to the displacement unit such that the at least one of the hydraulic driving device and the mechanical driving device drives the displacement unit.

Further, in accordance with another aspect of the present disclosure, one or more embodiments disclosed herein relate to a method to pump a fluid with a pumping system disposed within a downhole tool. The method includes providing a displacement unit having a cavity formed therein, the cavity configured to receive a fluid therein, and driving the displacement unit with one of a hydraulic driving device and a mechanical driving device such that the fluid is received within the cavity. The method further includes de-coupling the one of the hydraulic driving device and the mechanical driving device from the displacement unit, coupling the other of the hydraulic driving device and the mechanical driving device to the displacement unit, and driving the displacement unit with the other of the hydraulic driving device and the mechanical driving device such that the fluid is received within the cavity.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A pumping system to be used within a downhole tool, the system comprising:

a displacement unit having a first cavity formed therein, the first cavity configured to receive a fluid therein;

a hydraulic driving device configured to drive a first piston of the displacement unit such that the fluid is received within the first cavity; and a mechanical driving device configured to drive the first piston of the displacement unit such that the fluid is received within the first cavity;

wherein the hydraulic driving device is configured to couple to and de-couple from the displacement unit wherein, when coupled to the displacement unit, the hydraulic driving device is configured to drive the displacement unit.

2. The system of claim 1, wherein the mechanical driving device is configured to couple to and de-couple from the displacement unit, wherein, when coupled to the displacement unit, the mechanical driving device is configured to drive the displacement unit.

3. The system of claim 1, wherein at least one of the hydraulic driving device and the mechanical driving device is coupled to the displacement unit to drive the displacement unit.

4. The system of claim 1, wherein the displacement unit comprises a housing having a first chamber with the first piston disposed therein, thereby defining the first cavity and a second cavity within the first chamber.

5. The system of claim 4, wherein the displacement unit further comprises a second chamber with a second piston disposed therein, thereby defining a third cavity and a fourth cavity within the second chamber, the first piston and the second piston being connected to each other.

6. The system of claim 3, wherein the mechanical driving device comprises a roller screw coupled to the first piston of the displacement unit.

7. The system of claim 6, further comprising:

a latching mechanism to selectively couple the roller screw with the first piston of the displacement unit;

wherein the latching mechanism is at least one of hydraulically, magnetically, mechanically, and electrically actuated to couple the roller screw with the first piston of the displacement unit.

8. The system of claim 4, further comprising:

a valve block fluidly coupled to the second cavity of the displacement unit;

wherein the valve block is configured to enable a second fluid to be received within the second cavity of the displacement unit.

9. The system of claim 8, wherein the first fluid configured to be received within the first cavity is hydraulic fluid, and wherein the second fluid configured to be received within the second cavity is formation fluid.

10. The system of claim 1, further comprising:

a switch valve fluidly coupled to the first cavity of the displacement unit;

wherein the switch valve is configured to enable the hydraulic driving device to pump the fluid into the first cavity of the displacement unit.

11. The system of claim 1, further comprising:

a motor coupled to at least one of the hydraulic driving device and the mechanical driving device such that the motor is configured to provide power to the at least one of the hydraulic driving. device and the mechanical driving device.

12. The system of claim 1, wherein the hydraulic driving device is configured to drive the displacement unit at a flow rate range of about 1-150 cc/s (about 0.61-9.2 $in^3/s$), and wherein the mechanical driving device, is configured to drive the displacement unit at the flow rate range of about 0.1-40 cc/s (about 0.061-2.4 $in^3/s$).

13. A pumping system to be used within a downhole tool, the system comprising:

a displacement unit comprising a chamber with a piston disposed therein, the piston defining a first cavity and a second cavity within the first chamber;

a hydraulic pump configured to couple with the displacement unit using a switch valve, wherein the hydraulic pump is configured to pump hydraulic fluid into the first cavity of the displacement unit;

a roller screw configured to selectively couple with the piston of the displacement unit through a latching mechanism, wherein the roller screw is configured, when latched, to drive the piston such that hydraulic fluid is received, within the first cavity of the displacement unit;

a motor coupled to at least one of the hydraulic pump and the roller screw, wherein the motor is configured to provide power to the at least one of the hydraulic pump and the roller screw; and a valve block fluidly coupled to the second cavity (if the displacement unit, wherein the valve block is configured to selectively direct the formation fluid to the second cavity of the displacement unit.

14. The system of claim 13, wherein one of one of the hydraulic pump and the roller screw is coupled to the displacement unit to drive the displacement unit.

15. The system of claim 13, wherein the displacement unit further comprises a second chamber with a second piston disposed therein, thereby defining a third cavity and a fourth cavity within the second chamber, the first piston and the second piston being connected to each other.

16. The system of claim 15, wherein the hydraulic pump is configured to pump the hydraulic, fluid into the fourth cavity of the displacement unit, wherein the roller screw is configured to drive the second piston such that the hydraulic fluid is received, within the fourth cavity of the displacement unit, and wherein the valve block is configured to selectively direct the formation fluid to the third cavity of the displacement unit.

17. A method to manufacture a pumping system to be used within a downhole tool, the method comprising:

providing, a displacement unit having a cavity formed therein, the cavity configured to receive a fluid therein;

configuring a hydraulic driving device to couple to the displacement unit, wherein, when coupled to the displacement unit, the hydraulic driving device drives the displacement unit such that the fluid is received within the cavity;

configuring, a mechanical driving device to couple to the displacement unit, wherein, when coupled to the displacement unit, the mechanical driving device drives the displacement unit such that the fluid is received within the cavity; and selectively coupling at least one of the hydraulic driving, device and the mechanical driving, device to the displacement unit such that the at least one of the hydraulic driving device and the mechanical driving device drives the displacement unit, 18. The method of claim 17, further comprising:

coupling a motor to at least one of the hydraulic driving device and the mechanical driving device; and powering the at least one of the hydraulic driving device and the mechanical driving device with the motor.

19. A method to pump a fluid with a pumping system disposed within a downhole tool, the method comprising:

providing a displacement unit having a cavity formed therein, the cavity configured to receive a fluid therein;

driving the displacement unit with one of a hydraulic driving device and a mechanical driving device such that the fluid is received within the cavity;

de-coupling the one of the hydraulic driving device and the mechanical driving device from the displacement unit;

coupling the other of the hydraulic driving device and the mechanical driving device to the displacement unit; and driving the displacement unit with the other of the hydraulic driving device and the mechanical driving device such that the fluid is received within the cavity.

20. The method of claim 19, further comprising:

powering the one of the hydraulic driving device and the mechanical driving device with a motor such that the one of the hydraulic driving device and the mechanical driving device drives the displacement unit.

21. A pumping system to he used within a downhole tool, the system comprising:

a displacement unit having a cavity formed therein, the cavity configured to receive a fluid therein;

a hydraulic driving device configured to drive a piston of the displacement unit such that the fluid is received within the cavity; and a mechanical driving device configured to drive the piston of the displacement unit such that the fluid is received within the cavity:

wherein the hydraulic driving device comprises a hydraulic pump configured to pump fluid into the cavity of the displacement unit.

22. The system of claim 21 wherein the mechanical driving device is configured to couple to and de-couple from the displacement unit, wherein, when coupled to the displacement unit, the mechanical driving device is configured to drive the displacement unit.

* * * * *